US005119723A

United States Patent [19]

Lovitt, Jr.

[11] Patent Number: 5,119,723

[45] Date of Patent: Jun. 9, 1992

[54] APPARATUS FOR REMOVING OR INSTALLING RAILROAD TIES WITH 360 DEGREE ROTATABLE TIE HOLDING MEMBER

[76] Inventor: Estel L. Lovitt, Jr., 5102 Brendon Way, Sylvania, Ohio 43560

[21] Appl. No.: 567,720

[22] Filed: Aug. 15, 1990

[51] Int. Cl.[5] ..... E01B 29/10

[52] U.S. Cl. ..... 104/7.1; 104/9

[58] Field of Search ..... 104/5, 6, 7.1, 9

[56] References Cited

U.S. PATENT DOCUMENTS

| | | | |
|---|---|---|---|
| 2,762,313 | 9/1956 | Sublett | 104/7.1 X |
| 2,828,699 | 4/1958 | Fox | 104/9 |
| 3,698,324 | 10/1972 | Pippin et al. | 104/9 |
| 3,780,664 | 12/1973 | Holley et al. | 104/9 |
| 4,152,991 | 5/1979 | Stedman et al. | 104/7.1 |
| 4,392,433 | 7/1983 | Nyland | 104/9 |

*Primary Examiner*—Robert J. Oberleitner
*Assistant Examiner*—S. Joseph Morano
*Attorney, Agent, or Firm*—George R. Royer

[57] ABSTRACT

The subject invention is an improved apparatus adapted to facilitate the installation of railroad ties, either by automatic or semi-automatic members. The apparatus incorporating the features of the subject invention comprises, in general, a pair of laterally disposed stabilizing and leveling arms flexibly mounted to each side of a vehicle that is capable of riding on railroad tracks, and wherein each said stabilizing and leveling arm is in turn comprised of two flexible subarms flexibly mounted together in the manner of a parallelogram structure. Mounted at the end of the parallelgram-like subarms are flat brace members. Integrally affixed to the end of such flat brace members are self-levelling jacks. A flexible movable boom member is integrally mounted to a portion of such vehicle, with such boom member having a rotatable holding device rotatably and integrally affixed to the end of the boom arm, such holding device adapted to hold a portion of a tie member. The rotatable holding device can be rotated perpendicular to the railroad track and be used as a shovel for removing ballast. The apparatus incorporates retractable rail wheels so positioned to facilitate the removal and insertion as mounted on the center of the parallelogram-like subarms which are clamping devices that hold the tractor securely on the rail.

4 Claims, 3 Drawing Sheets

APPARATUS FOR REMOVING OR INSTALLING RAILROAD TIES WITH 360 DEGREE ROTATABLE TIE HOLDING MEMBER

DISCUSSION OF PRIOR ART AND BACKGROUND OF THE INVENTION

The subject invention pertains in general to devices that are used to automatically or semi-automatically install or remove railroad ties in a railroad bed. Such devices are generally deployed in a manner that function in the tie removal process to maintain railroad beds so as to minimize the manual labor input in such process. In this regard, it is to be noted that the upkeep of a railroad bed requires constant attention and maintenance. In many cases, the ties on a road bed must be replaced periodically in order to maintain the integrity of the road bed, and as stated, constant attention can be expensive with manual labor or other costs often proving burdensome.

As a result of this latter aspect, there have been many machines developed for the railroad industry that have aided in the process of automatically or semi-automatically removing railroad ties from a railroad bed. Such machines have yielded limited efficiency. Indeed, there are a number of machines used for this particular purpose. However, the known or existing machines used for this purpose have been, in many cases, not sufficient to perform properly and consistently for the tie replacement process with the desired efficiency and flexibility.

In view of the relative problems and shortcomings in relevant prior art, the subject invention has been conceived as an apparatus and processed as an improvement to facilitate, at minimal labor, the process of removing ties from a railroad bed. The following objects of the subject invention are set forth accordingly.

OBJECTS OF INVENTION

It is an object of the subject invention to provide an improved apparatus for removing and installing railroad ties;

It is also an object of the subject invention to provide an improved apparatus for facilitating tie removal in a railroad bed;

It is another object of the subject invention to provide an improved device for helping in railroad bed maintenance;

Still another object of the subject invention is to provide an improved device for inserting or removing railroad ties;

Yet another object of the subject invention is to provide an improved machine for removing and replacing railroad ties with minimal labor usage;

It is an object of the subject invention to provide an improved apparatus for railroad maintenance;

Other and further objects of the subject invention will become apparent from a reading of the following description in conjunction with the claims and drawings.

DRAWINGS

DESCRIPTION OF GENERAL EMBODIMENT

Figure 1:
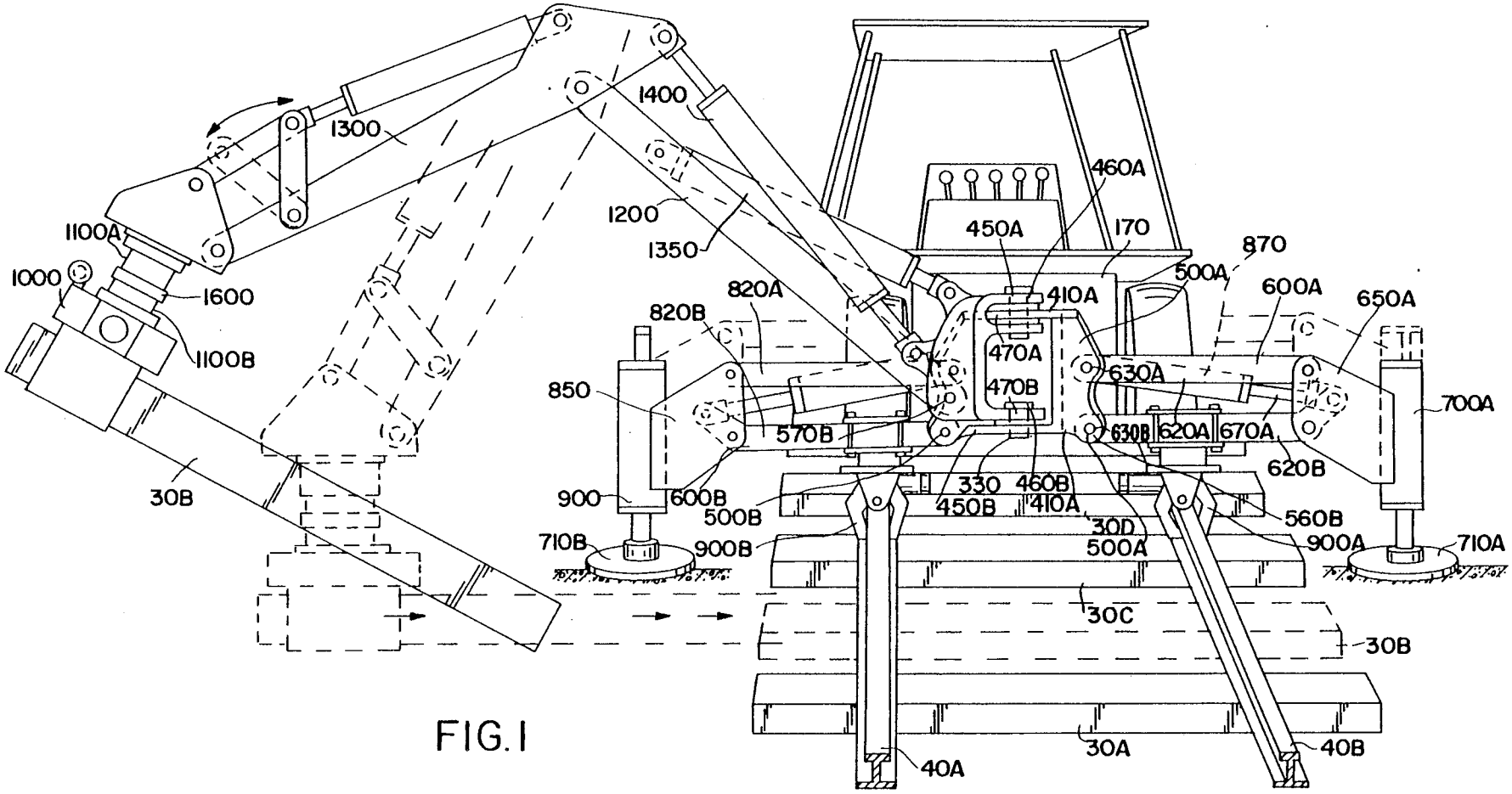
FIG. 1 is a front elevational and partially a perspective view of the subject invention, being shown as disposed on a railroad track in operation.

The subject invention is an improved apparatus adapted to facilitate the installation of railroad ties, either by automatic or semi-automatic means. The apparatus incorporating the features of the subject invention comprises, in general, a pair of laterally disposed stabilizing and leveling arms flexibly mounted to each side of a vehicle that is capable of riding on railroad tracks, and wherein each said stabilizing and leveling arm is in turn comprised of two flexible subarms flexibly mounted together in the manner of a parallelogram structure. Mounted at the end of the parallelogram-like subarms are flat brace members. Integrally affixed to the end of such flat brace members are self-leveling jacks. A flexible movable boom member is integrally mounted to a portion of such vehicle, with such boom member having a rotatable holding device rotatably integrally affixed to the end of the boom arm, such holding device adapted to hold a portion of a tie member.

In describing the preferred embodiment of the subject invention, it is to be noted that the following description shall be of one embodiment only of several that are within the scope of the invention herein, and this description of a particular embodiment shall not be considered as limiting the scope of the invention herein, as set forth in the claims. Moreover, in describing the subject invention, the following nomenclature shall be used. The word "upper" shall refer to those areas above the ground level on the motor vehicle, while the word "lower" will refer to those areas adjacent or near the ground level as appertaining to a conventionally disposed motor vehicle, as described. The words "longitudinal central axis" will refer to that axis which runs symmetrically from front to back through the front to back center line of such motor vehicle. The word "transverse" refers to direction and dispositions that are perpendicular to such longitudinal central axis.

DESCRIPTION OF PREFERRED EMBODIMENT

The following description is of only one embodiment within the scope of the subject invention, and therefore the following description shall not be construed in any manner as limiting the scope of the subject invention as set forth in the claims.

Referring now to the drawings in which a preferred embodiment of the subject invention is shown, a railroad bed 10 is shown as being disposed in a semi-integral manner to the adjacent ground 20. As can be seen in the drawings, the railroad bed comprises, in part, a plurality of railroad ties 30A, 30B, 30C, 30D, 30E, 30F, 30G, 30H . . . laid in a series arrangement, with special attention being given to a consistent spacing relationship between such ties, as shown in the drawings. Usually railroad ties, being longitudinally disposed rectangularly shaped members, such as the ties 30A, 30B, 30C, 30D, 30E, 30F, 30G, 30H . . . are partially disposed within a bed of rock ballast 35 in order to stabilize the ties in the railroad bed system. Integrally affixed over the upper surface of such ties 30A, 30B, 30C, 30D, 30E, 30F, 30G, 30H . . . are rail members 40A and 40B, affixed transversely and in parallel fashion over the upper surface of such ties by the conventional system of spiking the bottom edge of the rails to the upper surface of the ties. This railroad bed 10, as shown and described, is of conventional constructional arrangement. It is to be noted in this respect that other railroad bed arrangements may be utilized and that the application of this invention is not limited to usage on railroad beds of the type thusly described.

Figures 2, 3:
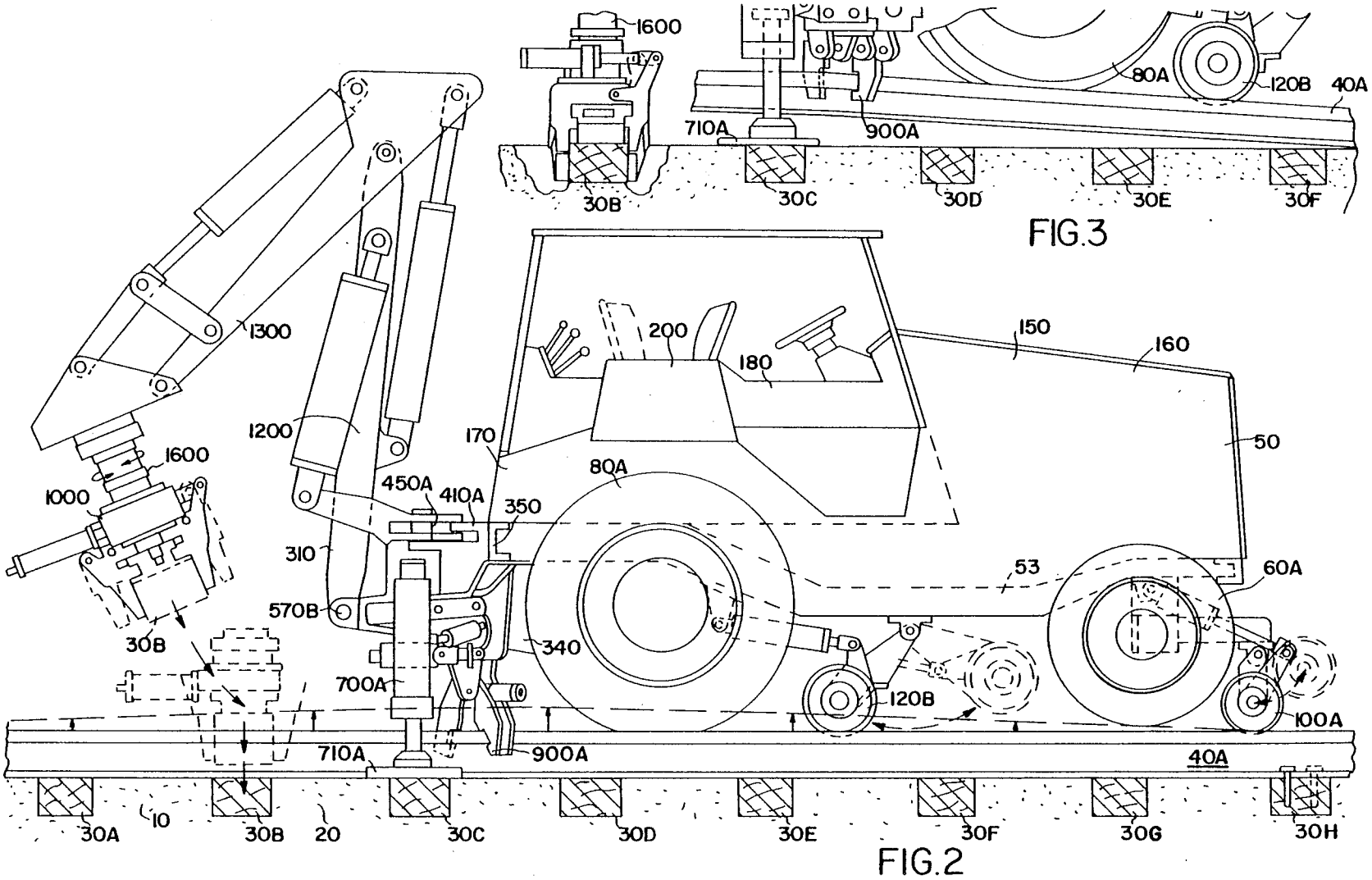
FIG. 2 is a side elevational view of the subject apparatus, showing the operational apparatus.
FIG. 3 is a side elevational view of the rail lifting mechanism as used relative to the subject device.
Figure 4:
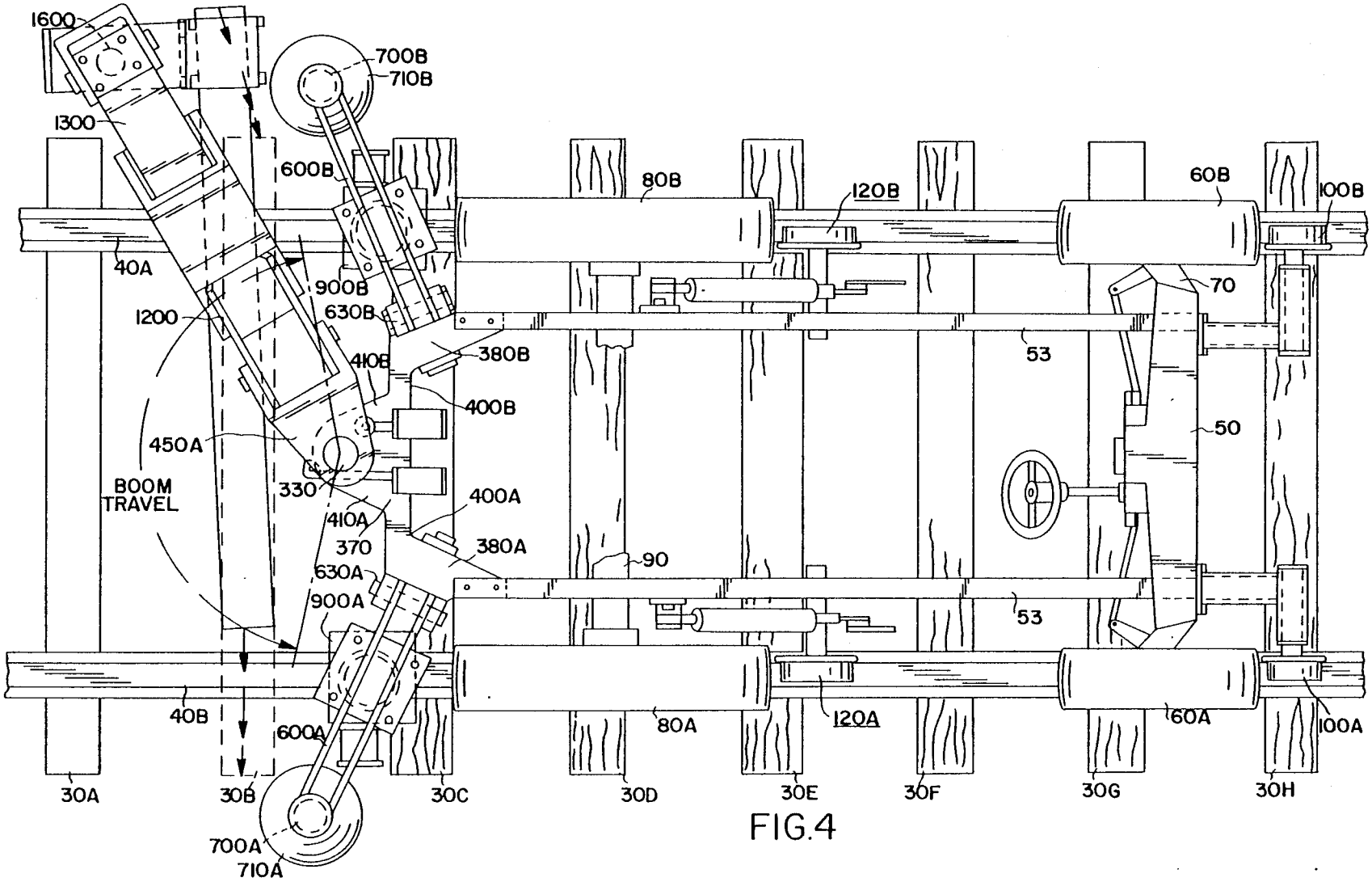
FIG. 4 is a top elevational view of the subject apparatus showing the subject device with the vehicular frame showing as operationally disposed on a railroad track.

As seen in FIGS. 1, 2 and 4, a motorized vehicle 50 is shown as being a vehicle adapted to ride over the rails 40A and 40B, and such vehicle 50 is based on a conventionally structured rectangular frame 53, although the frame structure may be other than rectangular for purposes of constructing the vehicle 50 and implementing the subject invention. Moreover, vehicle 50 may be a rail-based vehicle or it may be a land-based vehicle capable of riding over rails in addition to the ground or roadways. In such latter case, the vehicle 50 has both railroad wheels and over-the-ground wheels. The vehicle 50, shown in the drawings, with particular reference to figures 2 and 4, is that type of vehicle that is adapted to ride over both rails, such as rails 40A and 40B, as well as a roadway or ground. For this purpose, vehicle 50 is equipped with front-based road-based wheels 60A and 60B rotatably mounted on transverse axle member 70 mounted on frame 53. Moreover, said vehicle 50 is equipped with posterior oriented rear road-based wheels 80A and 80B. The latter road-based wheels 80A and 80B are rotatably mounted on rear axle 90, also mounted on frame 53. Also provided are road-based wheels 80A and 80B which are, as seen, adapted to ride over the upper surface of the railroad rails 40A and 40B whenever the vehicle 50 is driven over railroad rails, as opposed to the road surface. Vehicle 50 is additionally equipped with two separate pairs of rail wheels, specifically a front pair of rail wheels 100A and 100B rotatably mounted on separate coaxially-aligned axle members 110A and 110B, shown as being retractably and rotatably mounted to the front axle 70. A second pair of rear rail wheels 120A and 120B are rotatably mounted on separate, coaxially aligned axle members 130A and 130B, which latter axle members are also retractably and rotatably mounted to the rear axle 90 on frame 53. As can be seen in the drawings, with reference to FIGS. 1 and 2, disposed on frame 53 is the body 150 having a frontal portion 160 and a posterior portion 170. In the middle portion 180 of such body is integrally situated a cab unit 200 adapted to house vehicular controls and seating arrangements for an operator. As thusly described, the vehicular frame 53 and body 150, with combined retractable rail wheel structures, is generally conventionally known and no inventive concept is claimed in such vehicular construction. Moreover, it is to be noted that the precise wheel structure, frame structure, body construction, and cab locations are all exemplary and other constructional forms in this regard may be utilized for this purpose.

Again, as indicated above, the vehicle 50, as described above, has rail wheels 100A and 100B and 120A and 120B that are retractably mounted so that the rail wheels can be lowered to the extended downward position for transporting the vehicle 50 over rails, as shown in FIGS. 1, 2 and 3. In the upwardly retracted position, the rail wheels 100A, 100B and 120A and 120B are pulled upwardly so that the vehicle is only supported on rubber-based wheels 60A, 60B, 80A and 80B for over-the road or ground travel other than rail travel. No inventive concept is claimed in regard to the described concept of retractable rail wheels, as set forth, except that the rear rail wheels 120B . . . are positioned in an approximate medial position under the rail vehicle frame in order to help stabilize the overall apparatus when it is in operational use.

Integrally disposed in the posterior portion of the body 150 and frame 53 of the vehicle 50 is a functional working unit that comprises the main working elements affixed to the vehicle 50. More specifically, integrally disposed on the posterior portion 170 of the vehicular frame 53 is the working element 310 embodying features of the invention herein. Specifically, as shown in the drawings, the working element 310 is coupled on its lower posterior portion 330 to the rear extremity 340 of the vehicle frame 53, as seen in the drawings. More particularly, the lower posterior portion of the vehicle 50 has integrally affixed thereto a support brace 350 that forms and functions as the lower and main supportive structure for the working element 310, and particularly comprises a brace member 370, which when viewed in the upper elevational view of FIG. 4 is a trifurcated member comprised of laterally disposed sub-brace members 380A and 380B that are symmetrically disposed in such laterally opposed manner relative to the longitudinal central axis A—A. Moreover, as shown in the drawings, particularly FIG. 4, the sub-brace members 380A and 380B are angled outwardly in a slightly V-shaped fashion. As seen, particularly in FIG. 4, the inner portion of each of the sub-brace members 380A and 380B are affixed integrally to the posterior lateral portions of the vehicle 50 and frame 53 forming respectively the lower laterally disposed outboard portions of the vehicle 50. Joining in integral fashion the upper and lower portions of the posterior portion ends 400A and 400B respectively of the sub-brace members 380A and 380B are lateral connecting brace members 410A and 410B, which are horizontally disposed on the posterior portion of the vehicle 50, as seen. More particularly, as seen in the drawings, the upper portion of the frontal portions of the respective sub-brace members 380A and 380B is horizontal cross-brace member 410A, while horizontal cross-brace member 410B joins the lower frontal portions of such sub-brace members 380A and 380B. As shown in the upper elevational view of FIG. 4, the posterior, medial portion of each cross-brace members 410A and 410B are provided with a posterior extension member 450A and 450B, each which extension member is approximately triangular in shape, as seen from the upper elevational view of FIG. 4.

As seen in FIG. 4, each of the posterior extension members 450A and 450B has a circular opening 460A and 460B therein, which openings are of equal size and are coaxially aligned relative to one another along a common imaginary vertical axis. Such circular openings 460A and 460B are adapted to receive therethrough vertical pins 470A and 470B of cylindical configuration.

As can be seen in the drawings and particularly FIGS. 1 and 4, the extreme laterally disposed outboard portions 500A and 500B of the respective sub-brace members 380A and 380B are formed with openings 560A and 560B and 570A and 570B respectively. More particularly, openings 560A and 560B on sub-brace member 360A are aligned one above another in a substantial vertical relationship, while the openings 570A and 570B in sub-brace member 360B are similarly situated.

Shown in FIG. 1 are the stabilizing arms 600A and 600B that function to stabilize the vehicle 50 on the railroad roadbed 10 whenever the vehicle is in the functional mode. As can be seen, each stabilizing arm 600A and 600B is comprised of subarm members. More particularly, the stabilizing arm 600A is comprised of two subarms 620A and 620B as can be seen these latter subarms are mounted in parallel fashion as components of a flexible parallelogram, as seen. The inner ends of the subarms 620A and 620B are rotatably mounted through integrally connected pin members 630A and 630B through the circular openings 560A and 560B on the sub-brace member 360A. By this latter arrangement, the subarms 620A and 620B are capable of moving up and down a limited degree in parallel fashion about the sub-brace member 360A. The distal ends of each subarm 620A and 620B are fixedly connected to the inboard portion holding plate 650A. This holding plate 650A is also rotatably affixed to the end of air cylinder member 670A that when actuated will move the trapezoidal-shaped holding plate 650A up and down a limited distance relative to the ground, such distance depending on the length of the cylinder member 670A. Hydraulic actuation means, not shown, serve to activate the cylinder member 670A to move it about its pivot point in turn moving the holding plate 650A up and down. Integrally affixed on the outboard end of the holding plate 650A is a self-leveling jack member 700A which is adapted to hydraulically and automatically move up and down in the leveling process for the work vehicle 50. The base 710A of the jack 700A is a plate member adapted to rest on a portion of the roadbed surface.

In similar fashion a stabilizing arm 600A, the subarms 820A and 820B comprise the stabilizing arm 600B, and are parallel members rotatably mounted to the outboard ends of sub-brace member 360B. The outer ends of the subarm members 820A and 820B are, in turn, mounted to holding plate 850, which is, in turn, fixedly mounted to self-elevating jack member 900. Hydraulically actuated arm 870 is hydraulically actuated to move the stabilizing arm 600B. As can be seen, the stabilizing arms 600A and 600B serve to stabilize and elevate on each side the vehicle 50 so that track roadbed work can proceed.

As can be seen in FIGS. 1, 2 and 3, integrally affixed under the rear portion of frame 53 are rail clasping claw members 900A and 900B. Such claw members are adapted to lower to the rails 40A and 40B and graspingly close and lock the rail head. Then when the lifting jacks are elevated, the claws lift up the adjacent portion of the rails 40A and 40B as shown in FIG. 3, in order that a tie member, such as tie member 30A can be pulled out from under the rails 40A and 40B with relative facility.

In reference to FIG. 1, which is a frontal view of the working apparatus which incorporates features of the subject invention, a vertically disposed chuck member 1000 is rotatably affixed in the posterior portion of the bottom brace member 370. This chuck member 1000 is rotatably mounted through vertical pins 1100A and 1100B, as shown. As can be seen, rotatable chuck member 1000 is pivotably mounted for a horizontal movement in an arc of approximately 170° from left to right in equal degree about a central vertical axis which is coaxially aligned with the vertically disposed pins 1100A and 1100B. More specifically, the rotatable chuck 1000 has a forward end and a posterior portion, with the posterior portion having circular openings which are adapted to fit conformingly over the pins 1100A so that the chuck can rotate as seen in FIG. 4. As can be seen from the upper elevational view of FIG. 4, the rotatable chuck 1000 is affixed on its posterior end to a longitudinally extending rear boom member 1200 that forms the posterior portion of the working elements 310.

As can be seen from the drawings, the forward part of rear boom member 1200 is affixed to the posterior portion of a frontal boom member 1300. As seen in the drawings, the frontal boom member 1300 is also a longitudinally extending beam member. As shown in FIG. 1, the hydrualically actuated cylinder 1350 is privotally affixed on its frontal end to the chuck 1000 and is thence pivotally connected on its posterior end to the posterior portion of the rear boom member 1200. Thus, hydraulic cylinder 1350 controls the upward and downward movements of the posterior boom member 1200. On the other hand, hydraulic cylinder 1400 is also pivotally connected to the rear or posterior portion of the frontal boom member 1300 and controls, in part, the vertical movements of such boom member.

Disposed on the forward part of the frontal boom 1300 is a rotatable holding member 1600 constructed and adapted to grasp conformingly the end of a railroad tie member 30A, as can be observed in FIG. 1. The holding member 1600 can be rotated through an arc of 360° in order to move the tie around for placement purposes.

The rotatable holding member 1600 can be rotated perpendicular to the railroad tracks 10 into a digging position. The frontal boom 1300 that is attached to the rotatable holding device allows the movement when the boom cylinder is extended and retracted. By extending the boom cylinder, the rotatable holding member 1600 can dig ballast prior to tie removal and backfill ballast after the new tie is inserted. Mounted on the center of the parallelogram-subarms 600A and 600B are clamping devices 900A and 900B that hold the tractor securely on track when the rotatable holding device removes or inserts a new tie. Attached to the end of the parallelogram-like structure are extendable jack cylinders with self-leveling pads. When the jack cylinders are extended, the self-leveling pads will conform to the sloping track ballast for stabilizing the tractor. When the clamping devices are employed, the jack cylinders can be extended beyond ground level to lift the track off the ties for removal of the tie. Mounted on the tractor are retractable rail wheels that allow the tractor to get on and off track anywhere. When elevated above the track level, the road wheels 60A . . . and 80A . . . . are elevated above the track.

In summary, the subject invention is a machine constructed for removing railroad ties from a railroad bed, having railroad tracks, such machine comprising a vehicle adapted to ride on railroad tracks, such vehicle having a frame member with a frontal and a posterior portion and wherein such vehicle has a frontal portion and a posterior portion, and having brace means affixed to the posterior portion of such vehicle, such brace means having lateral portions, as well as frontal and posterior portions, and further having stabilizing arm members pivotally mounted to each of the two lateral portions of such brace member, each stabilizing arm having an outer end, and having lifting jack means affixed to the outer ends of the stabilizing arms, and additionally having boom means affixed to the rear portion of such brace member.

The subject invention can be further described as a machine constructed for removing railroad ties from a railroad bed, having railroad tracks, such machine comprising a vehicle adapted to ride on railroad tracks, such vehicle having a frame member with a frontal and posterior portion and wherein such vehicle has a frontal portion and a posterior portion, and having brace means affixed to the posterior portion of such vehicle, such brace means having lateral portions, as well as frontal and posterior portions, and further having stabilizing arm members pivotally mounted to each of the two lateral portions of such brace member, each stabilizing arm having an outer end and wherein such arm members comprise parallel members pivotally connected as paralleogram members, and having lifting jack means affixed to the outer ends of the stabilizing arms, with boom means affixed to the rear portion of such brace member.

In yet another summarization, the subject invention is a machine constructed for removing railroad ties from a railroad bed, having railroad tracks, such machine comprising a vehicle adapted to ride on railroad tracks, such vehicle having a frame member with a frontal and a posterior portion and wherein such vehicle has a frontal portion and a posterior portion, and having brace means affixed to the posterior portion of such vehicle, such brace means having lateral portions, as well as frontal and posterior portions, and further having stabilizing arm members pivotally mounted to each of the two lateral portions of such brace member, each stablizing arm having an outer end, and additionally having lifting jack means affixed to the outer ends of the stabilizing arms, with boom means affixed to the rear portion of such brace member, and with clasping means affixed to the posterior end of such boom means, such clasping means having a rotatable shaft to permit rotation of such clasping means.

Still another summarization of the subject invention includes a machine constructed for removing railroad ties from a railroad bed, having railroad tracks, such machine comprising a vehicle adapted to ride on railroad tracks, said vehicle having a frame member with a frontal and a posterior portion and wherein such vehicle has a frontal portion and a posterior portion, with brace means affixed to the posterior portion of such vehicle, and with lifting jack means affixed to the outer ends of the stabilizing arms, and further with boom means affixed to the rear portion of such brace member, and with horizontal rotation means disposed on the frame member of such vehicle whereby such boom means can be rotated 170° in a horizontal plane about a vertical axis.

I claim:

1. A machine constructed for removing railroad ties from a railroad bed, having railroad tracks, said machine comprising:

(a) a vehicle adapted to ride on railroad tracks, said vehicle having a frame member with a frontal and a posterior portion and wherein said vehicle has a frontal portion and a posterior portion;

(b) brace means affixed to the posterior portion of said vehicle, said brace means having lateral portions, as well as frontal and posterior portions;

(c) stabilizing arm members pivotally mounted to each of the lateral portions of said brace means, each stabilizing arm having an outer end;

(d) lifting jack means affixed to the outer ends of the stabilizing arms, said jack means having self stabilizing bases therein;

(e) boom means affixed to the posterior portion of said brace means said boom means comprising a forward end and a posterior end with the posterior end of said boom means having a holding member affixed thereon for rotation in a full circle while holding a railway tie in a fixed position;

(f) rail clasping claw members affixed to the frame member of said vehicle, said claw members being adapted lower to the railroad tracks and grasp a portion of the railroad track to raise said railroad track upon activation of said lifting jack means.

2. A machine constructed for removing railroad ties from a railroad bed, having railroad tracks, said machine comprising:

(a) a vehicle adapted to ride on railroad tracks, said vehicle having a frame member with a frontal and a posterior portion and wherein said vehicle has a frontal portion and a posterior portion, said vehicle having a longitudinally extending front to center axis;

(b) brace means affixed to the posterior portion of said vehicle, said brace means having latterally extending sub-brace portions, as well as frontal and posterior portions, said lateral extending sub-brace portions being symmetrically disposed relative to the longitudinally extending front center axis;

(c) stabilizing arm members privotally mounted to each of the lateral portions of said brace means, each stabilizing arm having an outer end and an inner end wherein said stabilizing arm members comprise parallel sub-arm members pivotally connected as parallelogram members, said stabilizing arm members each having a trapezoidally-shaped plate member disposed in the ends of such stabilizing arm members;

(d) lifting jack means affixed to the outer ends of each of the stabilizing arms, said lifting jack means having a plate on the bottom thereof to rest on the ground;

(e) boom means affixed to the posterior portion of said brace means, said boom means comprising a forward end and a posterior end with the posterior end of said boom means having a holding member affixed thereon for rotation in a full circle while holding a railway tie in a fixed position;

(f) rail clasping claw members affixed to the frame member of said vehicle, said claw members being adapted lower to the railroad tracks and grasp a portion of the railroad track to raise said railroad track upon activation of said lifting jack means.

3. A machine constructed for removing railroad ties from a railroad bed, having railroad tracks, said machine comprising:

(a) a vehicle adapted to ride on railroad tracks, said vehicle having a frame member with a frontal and a posterior portion and wherein said vehicle has a frontal portion and a posterior portion;

(b) brace means affixed to the posterior portion of said vehicle, said brace means having lateral portions, as well as frontal and posterior portions;

(c) stabilizing arm members pivotally mounted to each of the lateral portions of said brace means, each stabilizing arm having an outer end;

(d) lifting jack means affixed to the outer ends of the stabilizing arms;

(e) boom means affixed to the posterior portion of said brace means, said boom means comprising a forward end and a posterior end with the posterior end of said boom means having a holding member affixed thereon for rotation in a full circle while holding a railway tie in a fixed position;

(f) grasping means affixed to the posterior end of said boom means, said grasping means having a rotatable shaft to permit rotation of said grasping means;

(g) rail grasping claw members affixed to the frame member of said vehicle and adapted to be lowered to a portion of the railroad tracks and engage the same to raise said track portion upwardly upon actuation of the lifting jack means.

4. A machine constructed for removing railroad ties from a railroad bed, having railroad tracks, said machine comprising:

(a) a vehicle adapted to ride on railroad tracks, said vehicle having a frame member with a frontal and a posterior portion and wherein said vehicle has a frontal portion and a posterior portion;

(b) brace means affixed to the posterior portion of said vehicle, said brace means having lateral portions, as well as frontal and posterior portions;

(c) stabilizing arm members pivotally mounted to each of the lateral portions of said brace means, each stabilizing arm having an outer end;

(d) lifting jack means affixed to the outer ends of the stabilizing arms;

(e) boom means affixed to the posterior portion of said brace means, said boom means comprising a forward end and a posterior end with the posterior end of said boom means having a holding member affixed for rotation in a full circle while holding a railway tie in a fixed position;

(g) rail clasping claw members affixed to the frame member of said vehicle and adapted to be lowered to a portion of the railroad tracks and engage the same to raise said track portion upwardly upon actuation of the lifting jack means.

* * * * *